US010406539B2

(12) United States Patent
Lin et al.

(10) Patent No.: US 10,406,539 B2
(45) Date of Patent: Sep. 10, 2019

(54) REMOTE SWITCH COMBINATION SHOWER HEAD

(71) Applicants: XIAMEN SOLEX HIGH-TECH INDUSTRIES CO., LTD., Xiamen, Fujian (CN); Huasong Zhou, Xiamen, Fujian (CN)

(72) Inventors: Fengde Lin, Fujian (CN); Mingfu Zhang, Fujian (CN); Wenxing Chen, Fujian (CN)

(73) Assignee: XIAMEN SOLEX HIGH-TECH INDUSTRIES CO., LTD., Xiamen (CN)

( * ) Notice: Subject to any disclaimer, the term of this patent is extended or adjusted under 35 U.S.C. 154(b) by 0 days.

(21) Appl. No.: 15/362,251

(22) Filed: Nov. 28, 2016

(65) Prior Publication Data

US 2017/0173603 A1 Jun. 22, 2017

(30) Foreign Application Priority Data

Dec. 18, 2015 (CN) ..... 2015 1 0957389

(51) Int. Cl.

| | |
|---|---|
| ***B05B 1/16*** | (2006.01) |
| ***B05B 1/18*** | (2006.01) |
| ***B05B 12/00*** | (2018.01) |
| ***E03C 1/02*** | (2006.01) |
| ***E03C 1/04*** | (2006.01) |
| ***B05B 15/65*** | (2018.01) |
| ***B05B 15/63*** | (2018.01) |
| ***B05B 15/654*** | (2018.01) |

(52) U.S. Cl.

CPC ..... *B05B 1/1663* (2013.01); *B05B 1/1636* (2013.01); *B05B 1/1681* (2013.01); *B05B 1/18* (2013.01); *B05B 12/002* (2013.01); *B05B 15/63* (2018.02); *B05B 15/65* (2018.02); *E03C 1/025* (2013.01); *E03C 1/0408* (2013.01); *B05B 15/654* (2018.02)

(58) Field of Classification Search

CPC ..... B05B 1/1663; B05B 1/18; B05B 12/002; B05B 15/061; B05B 15/065; E03C 1/025; E03C 1/0408

See application file for complete search history.

(56) References Cited

U.S. PATENT DOCUMENTS

| | | | | |
|---|---|---|---|---|
| 9,707,574 | B2 * | 7/2017 | Soetaert | B05B 1/18 |
| 2015/0041562 | A1 * | 2/2015 | Peel | B05B 1/1654 239/447 |
| 2015/0360243 | A1 * | 12/2015 | Soetaert | B05B 1/18 4/615 |

FOREIGN PATENT DOCUMENTS

| | | |
|---|---|---|
| CN | 201776206 U | 3/2011 |

* cited by examiner

*Primary Examiner* — Christopher S Kim
(74) *Attorney, Agent, or Firm* — Rabin & Berdo, P.C.

(57) ABSTRACT

A remote switch combination shower head includes a first shower head, a second shower head and a switch mechanism, wherein further comprising a fixing seat assembled to a support arm, the fixing seat is disposed with an inlet waterway connected to the support arm, a first diversion waterway and a second diversion waterway; the first shower head is assembled to the fixing seat and is capable of connecting to the first diversion waterway; the second shower head is a hand shower head connected to the second diversion waterway by a flexible pipe; the switch mechanism comprises a switch component and an operation component, the switch component is disposed to the fixing seat and is coupled to the inlet waterway, the first diversion waterway and the second diversion waterway, so that the waterways are switched by the movement of the switch component.

14 Claims, 12 Drawing Sheets

REMOTE SWITCH COMBINATION SHOWER HEAD

FIELD OF THE INVENTION

The present invention relates to a combination shower head, especially to a combination shower head with its waterways remote switched.

BACKGROUND OF THE INVENTION

There is a combination shower head published in the Chinese patent database with announcement number CN201776206U, the combination shower head comprises a overhead shower head main body comprising an inlet waterway, a first waterway and a second waterway connected to the inlet waterway, the first waterway is connected to the outlet panel of the overhead shower head, the second waterway is connected to a hand shower head main body by a flexible pipe, the connection of the inlet waterway and the first, second waterway is disposed with a valve spool set, the float valve spool of the valve spool seat is movable left and right in the valve seat, the inlet passage of the hand shower head main body is connected to the second waterway of the overhead shower head main body, the hand shower head main body further comprises two outlet passages connected to the inlet passage, a normal off switch and a switch are disposed between the inlet passage and the two outlet passages in order, a pendulum bar is disposed between the normal off switch and the switch to achieve linkage so as to switch the overhead shower head and the hand shower head. The valve spool set is directly disposed in the overhead shower head main body that it makes the overhead shower head with complicated structure, it also occupies large space.

SUMMARY OF THE INVENTION

The present invention is provided with a remote switch shower head, which overcomes the disadvantages of the existing known technology.

The technical proposal of the present invention is that:

A remote switch combination shower head, comprising a first shower head (20), a second shower head (30) and a switch mechanism, wherein further comprising a fixing seat (10) assembled to a support arm, the fixing seat (10) is disposed with an inlet waterway (11) connected to the support arm, a first diversion waterway (12) and a second diversion waterway (13); the first shower head (20) is assembled to the fixing seat (10) and is capable of connecting to the first diversion waterway (12); the second shower head (30) is a hand shower head connected to the second diversion waterway (13) by a flexible pipe (50); the switch mechanism comprises a switch component (40) and an operation component (41), the switch component (40) is disposed to the fixing seat (10) and is coupled to the inlet waterway (11), the first diversion waterway (12) and the second diversion waterway (13), so that the waterways are switched by the movement of the switch component (40), the operation component (41) is disposed to the second shower head (30) to control the switch component to move.

In another preferred embodiment, the first shower head (20) is rotatably connected to the fixing seat (10).

In another preferred embodiment, a damping mechanism (60) is disposed between the fixing seat (10) and the first shower head (20).

In another preferred embodiment, the damping mechanism comprises a position seat (61), a rotation block (62) and a cam (63), the position seat (61) is disposed with at least two suspending sheets (64) arranged with space in the periphery, the suspending sheets (64) are surrounded to form a similar revolution sleeve, the inner wall of the similar revolution sleeve is disposed with at least a gradient section with semi-diameter gradually changed, the cam (63) is disposed in the similar revolution sleeve and coupled to the gradient section, the rotation block (62) is sleeved on the outer side of the similar revolution sleeve, when the cam (63) rotates and couples to the gradient section, the friction between the suspending sheet (64) and the rotation block (62) changes to achieve the adjusting of the damping.

In another preferred embodiment, the rear side of the fixing seat (10) is protruding with an assembly portion (14), the switch component (40) is assembled in the assembly portion (14); the outlet of the second diversion waterway (13) is corresponding to the periphery wall of the assembly portion (14), the front side of the fixing seat (10) is disposed with a connecting structure (15) for the positioning of the second shower head (30).

In another preferred embodiment, the fixing seat (10) is disposed with a common portion (16) and two fork portions (17) forking arranged and fixedly connected to the common portion (16), the first shower head (20) is rotatably connected between the two fork portions (17); a pipe section (21) is further configured along the rotating axis of the first shower head (20), a part of the first diversion waterway (12) is connected to the first shower head (20) along the pipe section (21).

In another preferred embodiment, the assembly portion (14) is disposed at the rear side of the common portion (16).

In another preferred embodiment, the fixing seat (10) is disposed with a common portion (16), the first shower head (20) is rotatably connected to the common portion (16); at least one pipe section is further configured along the rotating axis of the first shower head (20), a part of the first diversion waterway (12) is connected to the first shower head (20) along the pipe section (21).

In another preferred embodiment, the second shower head (30) is disposed with a control unit (42) used to control the on-off of the second diversion waterway (13), the operation component (41) is connected to the control unit (42) in driving way to control the on-off of the second diversion waterway (13);

the fixing seat (10) comprises a water diversion portion, the water diversion portion is disposed with a throughout water passage (181) and a receiving passage (182) connected to the non-port of the water passage (181), two ports of the water passage (181) respectively form the inlet of the first diversion waterway (12) and the inlet of the second diversion waterway (13), the water passage (181) and the receiving passage (182) form the inlet waterway (11);

the switch component (40) comprises a valve spool slidable with respect to the water diversion portion, the valve spool comprises a fixing rod (43) in the water passage (181) and a sealing portion (44) and a hydro portion (45) respectively fixedly connected to two ends of the fixing rod (43), the area of the water flowing acts on the sealing portion and that acts on the hydro portion (45) are unequal, the on-off of the second diversion waterway (13) makes the water pressure unequal to the sealing portion (44) and the hydro portion (45) so as to drive the valve spool to slide, therein: when the second diversion waterway (13) is situated in on state, the first diversion waterway (12) is closed by the sealing portion (44), water flows out of the second diversion waterway (13);

when the second diversion waterway (13) is situated in off state, water flows out of the first diversion waterway (12).

In another preferred embodiment, the hand shower head is disposed with a hand portion and a shower head portion, the operating component (41) is disposed in the hand portion, the rear side of the shower head portion or the front side of the shower head portion.

Compared to the existing technology, the technical proposal of the present invention has advantages:

1. The present invention is disposed with the fixing seat, the first shower head is connected to the fixing seat, the switch component is disposed with the fixing seat, the operation element is disposed to the hand shower head, on one hand, it is convenient to switch the outlet, on the other hand, the first shower head can be a new designed shower head or an existing shower head, it is configured with reliability, the structure is simple and compact.
2. The fixing seat is disposed with the common portion and the fork portions, the first shower head is rotatably connected between the two fork portions, the first shower head is rotatable, so that it is convenient for the user to adjust the outlet angle of the first shower head as needed.
3. The damping mechanism is disposed between the fork portion of the fixing seat and the first shower head that it is convenient to position the first shower head that the adjusted angle.
4. The cam is rotatably coupled to the gradient section to make the friction force of the suspending sheet and the rotation block change, so as to adjust the damping, the structure is simple and compact, it is convenient to adjust the damping force.
5. The connecting structure to position the hand shower head is disposed at the lower portion of the front side of the fixing seat that it is convenient for user to take down the hand shower head or place the hand shower head, the appearance is attractive.
6. The rear side of the fixing seat is disposed with the assembly portion, the switch mechanism is assembled in the assembly portion, the arrangement is reliable, the structure is compact, the appearance is attractive, it is convenient for the user to operate.
7. the water diversion portion is disposed with the water passage and the receiving passage, two ends of the water passage are respectively form the inlet of the first diversion waterway and the inlet of the second diversion waterway, the area of the water flowing acts on the sealing portion and that acts on the hydro portion are unequal, the on-off of the second diversion waterway makes the sealing portion and the hydro portion pressed by unequal hydro force so as to drive the valve spool to slide, it has high operation accuracy.

BRIEF DESCRIPTION OF THE DRAWINGS

The present invention will be further described with the drawings and the embodiments.

FIG. 5-1 illustrates an enlargement diagram of FIG. 4 in the control unit when water is turned on.

FIG. 5-2 illustrates an enlargement diagram of FIG. 4 in the control unit when water is turned off.

DETAILED DESCRIPTION OF THE EMBODIMENTS

The First Embodiment

Figure 1:
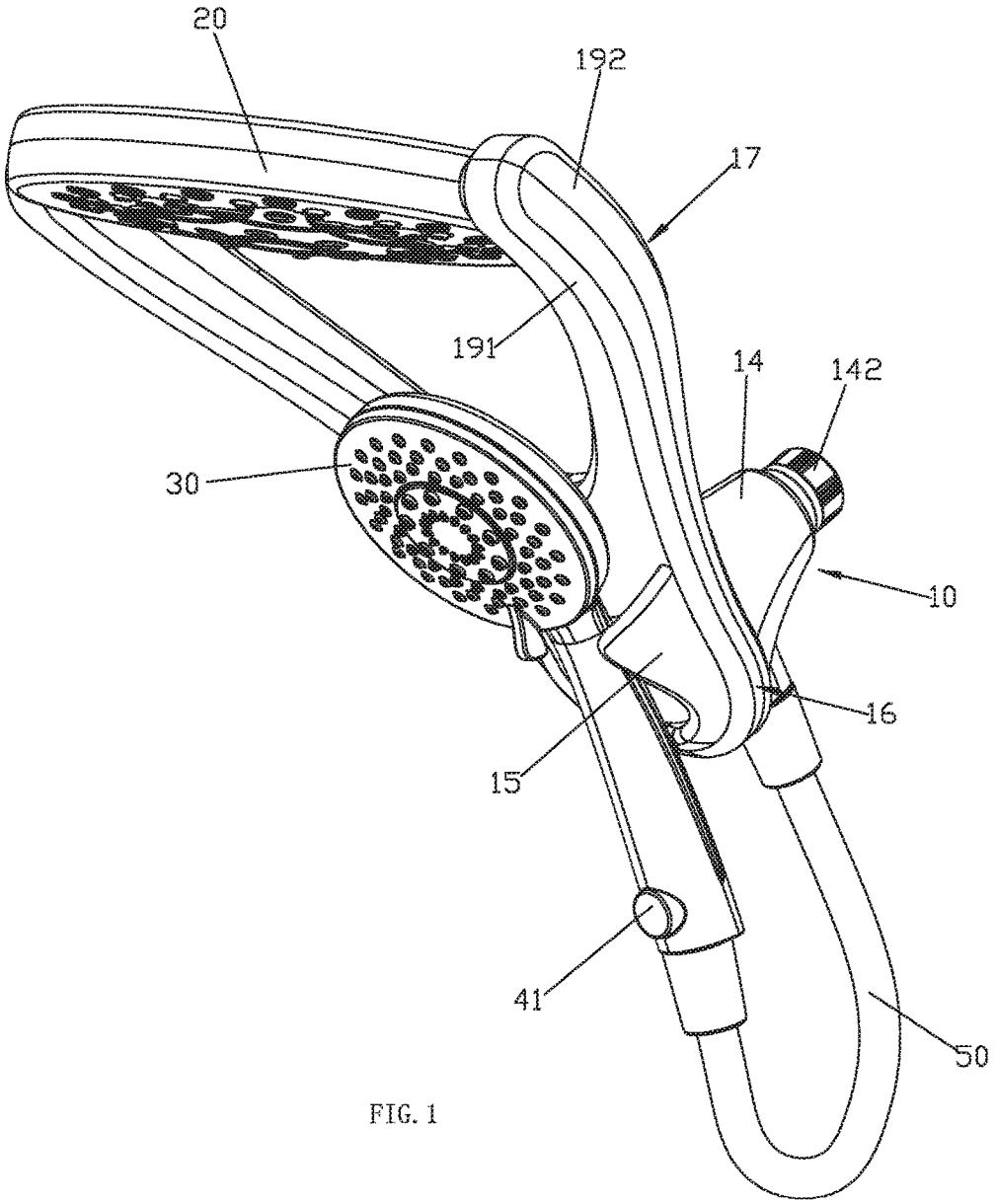
FIG. 1 illustrates a schematic diagram of the combination shower head of the first embodiment.
Figure 2:
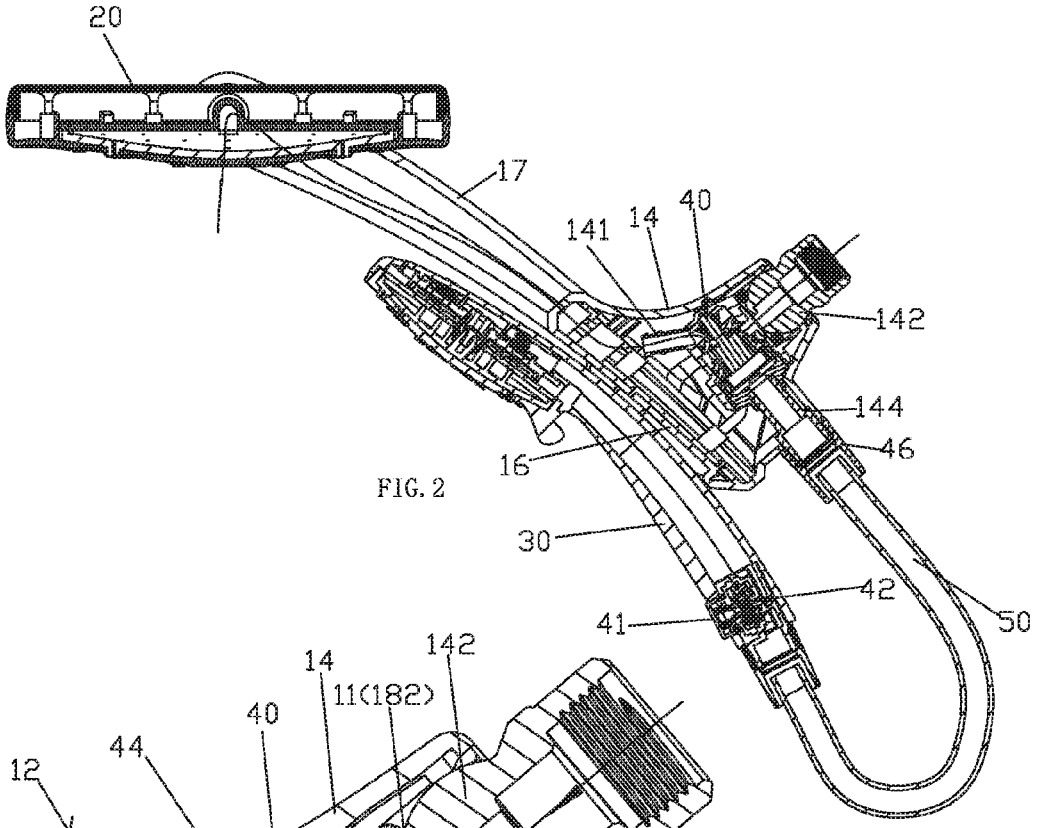
FIG. 2 illustrates a sectional diagram of the combination shower head of the first embodiment when water flows out of the first shower head.
Figure 3:
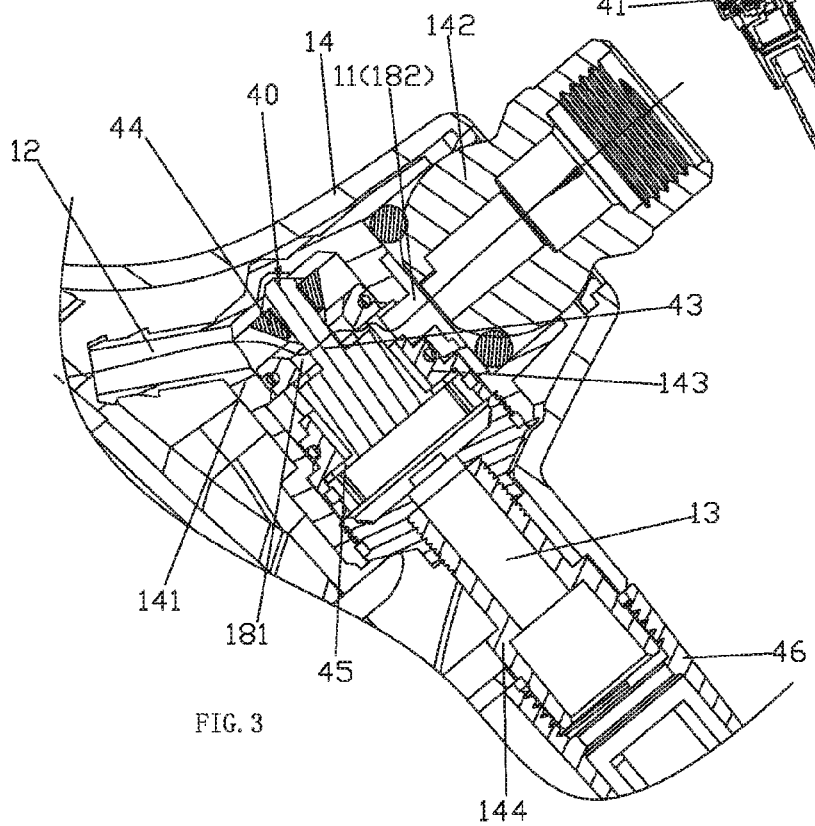
FIG. 3 illustrates an enlargement diagram of FIG. 2 in the switch component.
Figure 4:
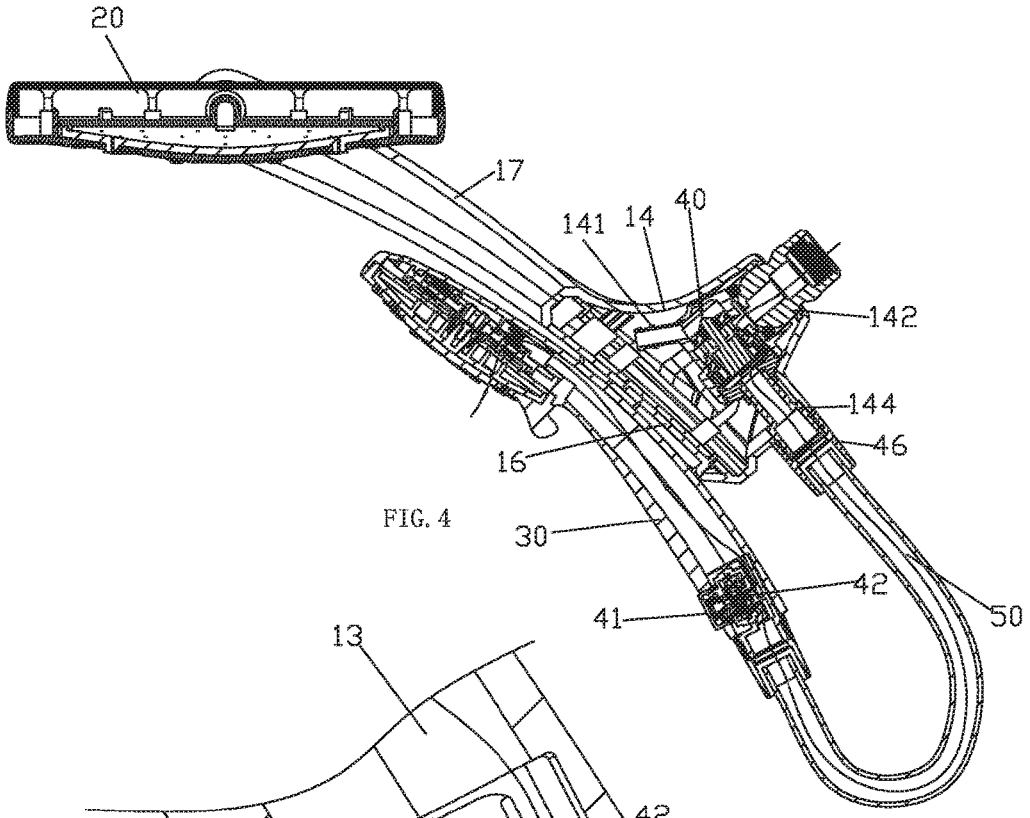
FIG. 4 illustrates a sectional diagram of the combination shower head of the first embodiment when water flows out of the second shower head.

Please referring to FIGS. 1-9, the remote switch combination shower head comprises a fixing seat 10, a first shower head 20, a second shower head 30, a switch mechanism and a flexible pipe 50. The fixing seat 10 can be assembled to a support arm, which can be a water supply pipe fixed on the wall, the assembly way can be fixing way or universally connecting way with a ball structure. The first shower head 20 is an overhead shower head or a head shower head, which is assembled to the fixing seat 10. The first shower head 20 is disposed with a plurality of outlet functions of different water types, or it can be disposed with only one outlet function. The second shower head 30 is a hand shower head. The fixing seat 10 is disposed with an inlet waterway 11 connected to the support arm, a first diversion waterway 12 and a second diversion waterway 13; the first diversion waterway 12 is connected to the first shower head 20, the second diversion waterway 13 is connected to the second shower head 30 by a flexible pipe 50.

The fixing seat 10 is disposed with a common portion 16 and two fork portions 17 forked arranged fixedly connected to the common portion 16, the rear side of the common portion 16 of the fixing seat 10 is protruding with an assembly portion 14. In this embodiment, the fixing seat 10 comprises a front cover 191 and a rear cover 192 both fixedly connected together to form above mentioned common portion and the fork portions, the rear cover is disposed with a through hole corresponding to the common portion, the periphery edge of the through hole extends oppositely to form the assembly portion 14. The front side of the common portion is disposed with a connecting structure 15 for the positioning of the hand shower head, the connecting structure 15 can be socket, but not limited to this, it can be a magnetic structure. The second diversion waterway 13 further comprises a joint 46 fixedly connected to a waterway of the water diversion body, the port of the joint 46 is an outlet, the joint passes through the assembly portion 14, the hand shower head is connected to the corresponding joint 46 by the flexible pipe 50.

The switch mechanism comprises a switch component 40, an operation component 41, a control unit 42. The control unit 42 is disposed in the second shower head 30 to control the on-off of the second diversion waterway 13. The fixing seat 10 comprises a water diversion portion, which is disposed with a throughout water passage 181 and a receiving passage connected to the non-port of the water passage 181, two ports of the water passage 181 are respectively forming the inlets of the first diversion waterway 12 and the second diversion waterway 13, the water passage 181 and the receiving passage 182 form a part of the inlet waterway 11, the section area of the inlet of the first diversion waterway 12 is smaller than the section area of the inlet of the second diversion waterway 13, if the inlets are circle, the diameter of the inlet of the first diversion waterway 12 is smaller than that of the second diversion waterway 13. The switch component 40 comprises a valve spool that is slidable with respect to the water diversion portion, the valve spool comprises a fixing prod 43 in the water passage 181, two sealing portions 44 respectively fixed to the two ends of the fixing rod 43 and a hydro portion 45, the fixing rod 43 and the internal wall of the water passage 181 are arranged with space partially for water flowing to the inlets of the first and second diversion waterway, the fixing rod 43 is concaved with a through groove arranged along the length of the fixing rod, the sealing portion 44 is disposed at the outer side of the inlet of the first diversion waterway 12 and is coupling to the inlet of the first diversion waterway 12 to close the inlet of the first diversion waterway 12, the external diameter of the sealing portion 44 is larger than the diameter of the inlet of the first diversion waterway 12, the hydro portion 45 is disposed at the outer side of the second diversion waterway 13. The area of the water flowing acts on the sealing portion and that acts on the hydro portion are unequal, so that the water flow changes due to the on-off of the second diversion waterway 13 and acts on the sealing portion 44 and the hydro portion 45 with unequal force, so that the valve pool is pressed by a resultant force to slide. Therein, when the second diversion waterway 13 is situated in on state, the hydro portion and the sealing portion are pressed by opposite force, the force pressing on the hydro portion by the water flowing is larger than that on the sealing portion, the direction of the resultant force pressing on the valve spool is from the inlet of the first diversion waterway 12 to the inlet of the second diversion waterway 13, making the valve spool move towards the inlet of the second diversion waterway 13, the inlet of the first diversion waterway 13 is closed by the sealing portion, the hydro portion and the inlet of the second diversion waterway are separated, the inlet of the first diversion waterway is closed, the inlet of the second diversion waterway is open, water flows out of the second diversion waterway 13; when the second diversion waterway 13 is closed to be in the off-state, the hydro portion and the sealing portion are pressed with equal force with the direction from the inlet of the second diversion waterway 13 to the inlet of the first diversion waterway 12, so that the valve spool moves towards the inlet of the first diversion waterway 12, the sealing portion and the inlet of the first diversion waterway are separated, the second diversion waterway is cut off by the control unit 42 to be in the off state, the inlet of the first diversion waterway is open, water flows out of the first diversion waterway 12. That is to say, in this embodiment, the switch component 40 is disposed in the assembly portion 14 of the fixing seat 10 and is coupled to the inlet waterway 11, the first diversion waterway 12 and the second diversion waterway 13 to switch the waterways by the movement of the switch component 40, the operation component 41 is disposed in the second shower head to control the switch component to move.

The first shower head 20 is rotatably disposed between the two fork portions 17. A pipe section 21 is disposed along the rotating axis of the first shower head 20, one end of the pipe section 21 is connected to the first shower head 20, the other end is fixedly disposed with a water pipe, the pipe section 21 and the water pipe form a L shaped structure, the first diversion waterway is connected to the first shower head by the water pipe and the pipe section 21.

A damping mechanism 60 is disposed between one fork portion 17 of the fixing seat 17 and the first shower head 20. In detailed, the damping mechanism 60 comprises a position seat 61, a rotation block 62 and a cam 63, the position seat 61 comprises a base and two suspending sheets 64 arranged with space in the periphery direction and fixedly connected to the position seat 61, two suspending sheets 64 surround to form a similar revolution sleeve (two adjacent suspending sleeves form a cut slot therebetween), the external wall of the similar revolution sleeve is the revolution surface, the semi-diameter of the internal wall of the similar revolution sleeve changes gradually to form a gradient section, the cam 63 is disposed in the similar revolution sleeve to abut against the gradient section; the rotating block 62 is sleeved on the outer side of the similar revolution sleeve, the cam 63 rotates to couple to the gradient section to make the stress between the suspending sheets 64 and the rotating block 62 change, thus making the friction therebetween change, so as to adjust the damping. Preferred, the base is throughout to make one end face of the cam 63 exposed, the end face is disposed with a fitting groove 631 for the user to drive the cam to rotate by tool. The position seat 61 and the rotating block 62 are respectively fixedly connected to two components that are rotatable relatively, for example the fork portion and the first shower head.

In this embodiment, the fixing seat further comprises a ball joint 142, the water diversion portion, the assembly portion 14 and the ball joint are coupled to assemble to the support arm. The water diversion portion comprises a water diversion body 141, an insert sleeve 143 and a connecting sleeve 144; the water diversion body 141 is disposed with above mentioned water passage 182 and a throughout step hole, the insert sleeve is inserted to the big hole of the step hole, the connecting sleeve 144 is threaded connected to the step hole to abut against the insert sleeve to fix the water diversion body, the insert sleeve and the connecting sleeve, the connecting sleeve is further threaded to the joint 46. The step hole and the inner hole of the insert sleeve form the water passage 181, the insert sleeve is a step sleeve with big outside and small inside, the step surface forms the end face of the inlet of the second diversion waterway, the hydro portion is coupled to the step surface of the step sleeve.

Figures 1, 5:
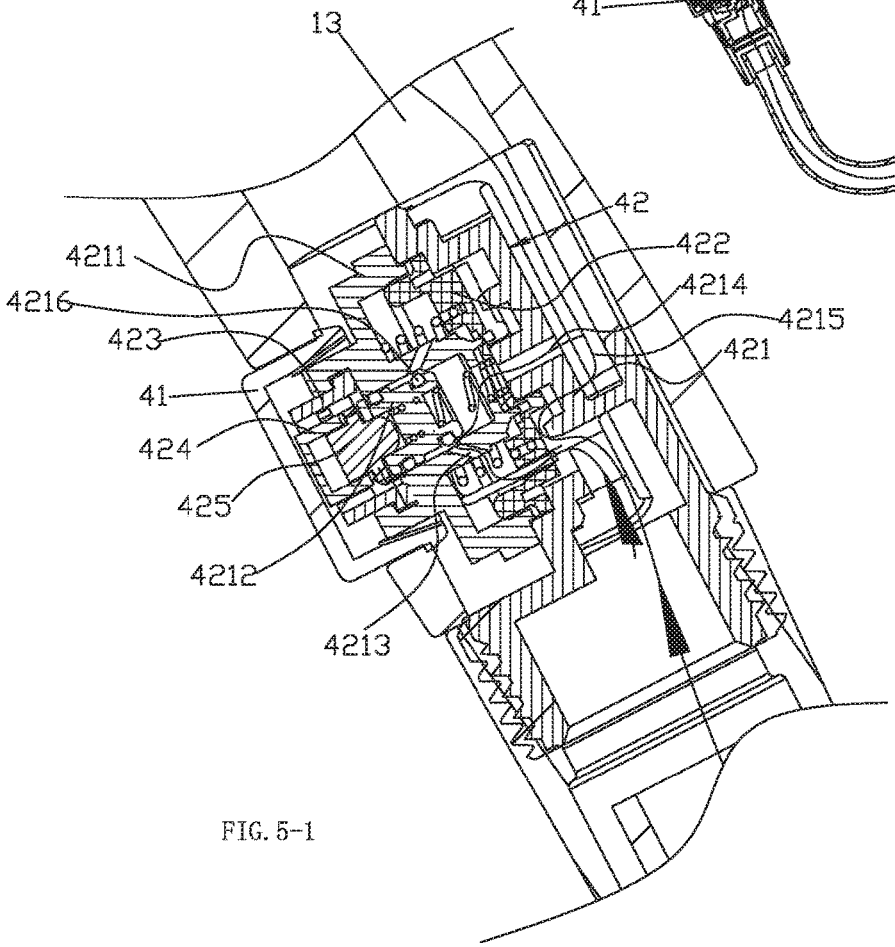
Figures 2, 5:
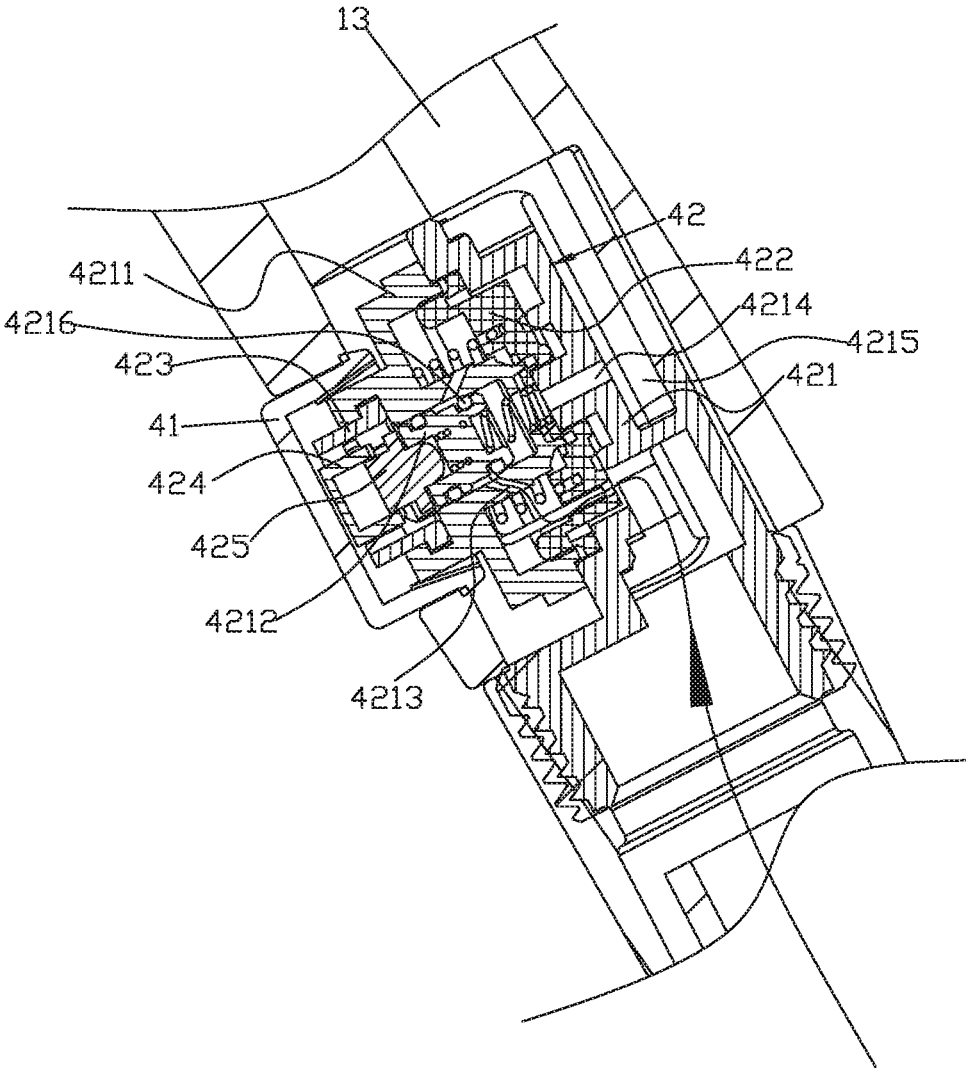
Figure 6:
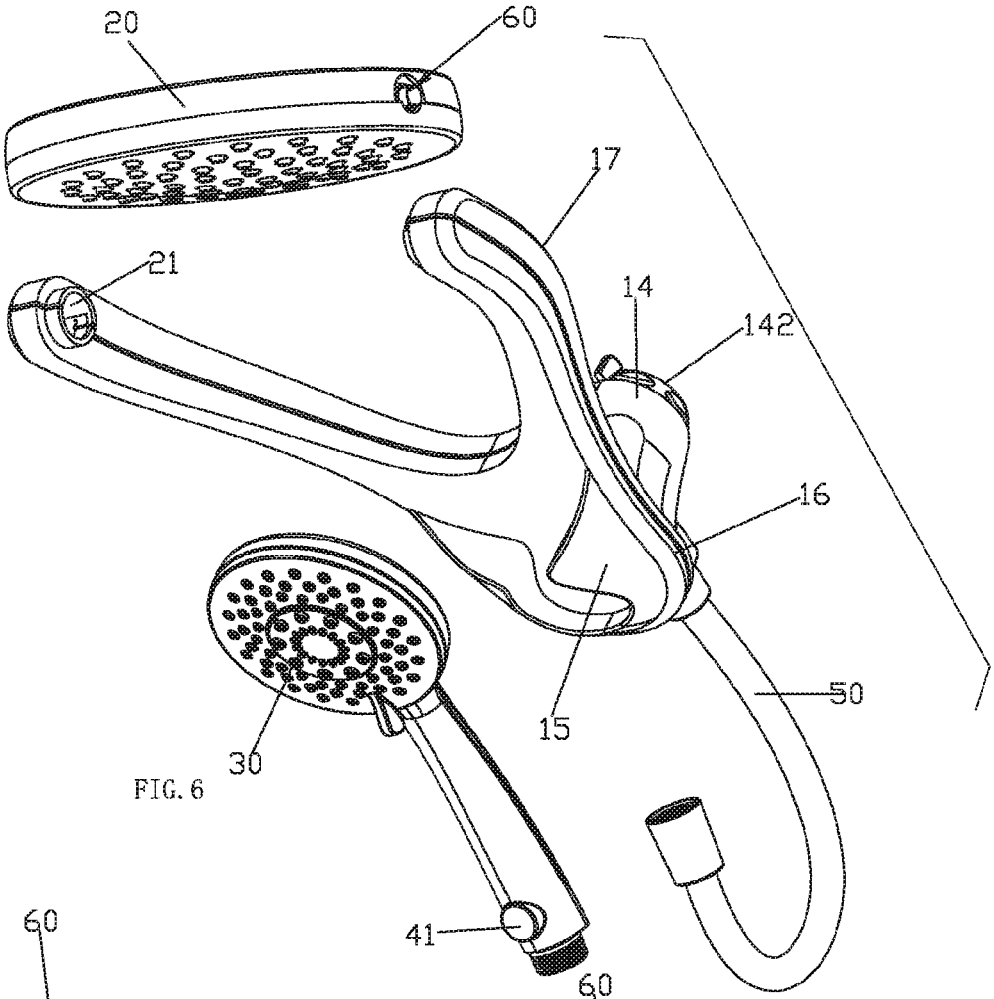
FIG. 6 illustrates a schematic and exploded diagram of the combination shower head of the first embodiment.
Figure 7:
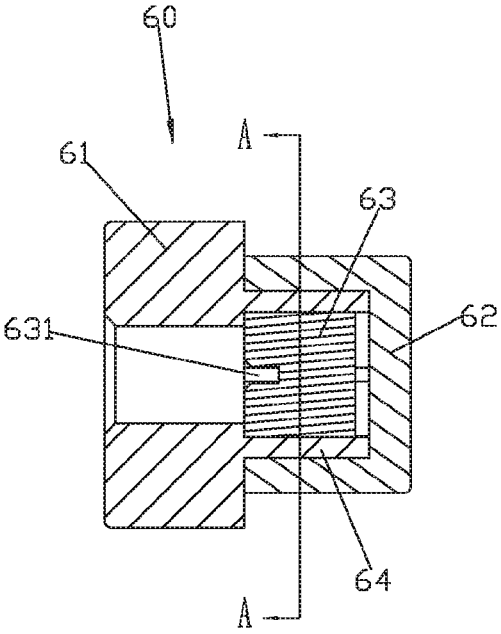
FIG. 7 illustrates a sectional diagram of the damping mechanism of the first embodiment.
Figure 8:
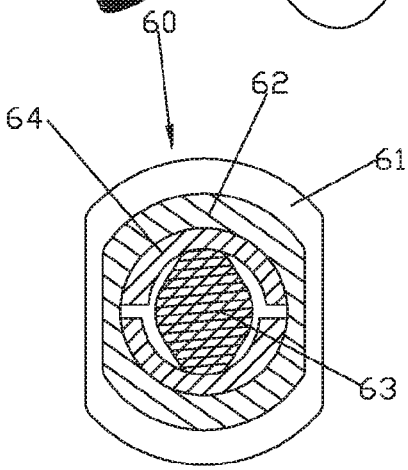
FIG. 8 illustrates a sectional diagram of FIG. 7 in A-A.
Figure 9:
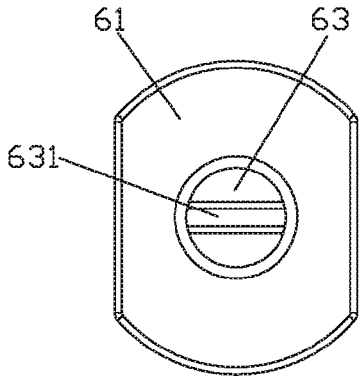
FIG. 9 illustrates a front diagram of the damping mechanism of the first embodiment.

The hand shower head is disposed with a hand portion and a shower head portion, the operation component 41 is disposed in the hand portion. Referring to FIG. 5-1 and FIG.

5-2, the control unit 42 comprises a fixing seat 421, a sealing pad 422, a valve body 423, a valve spool 424, a valve shaft 425, a water diversion body 4211 and a slide block 4212. The operation component is a press button, the fixing seat 421 is fixedly connected to the hand portion and is disposed with a portion forming the second diversion waterway, it is disposed to the water passage 4215 of the hand portion, the sealing pad 422 is coupled to the water passage, so that the on-off of the water passage is controlled by the movement and/or deformation of the sealing pad 422. The valve body 423, the valve spool 424 and the valve shaft 425 form a pencil structure. The water diversion body 4211 is fixedly connected to the fixing seat 421, the sliding block 4212 is slidably connected in the water diversion body 4211, the sliding block 4212 is abutted by a first spring. A second spring is disposed between the sealing pad 422 and the water diversion body 4211, so that the sealing pad 422 is pressed by the elastic force of the second spring towards the water passage.

Pressing the button to drive the valve spool to move up, as with the valve spool, the valve body and the upper incline teeth of the valve shaft, the valve shaft would be placed in high position or low position, the sliding block and the valve shaft move synchronously by the action of the first spring, when the valve shaft is in the high position, the sliding block is situated in the high position as figured, the O-ring 4216 of the sliding block and the water diversion body are situated in close state, the small waterway 4213 can not connected to the decompression hole 4214, this is like a communicating vessel, water pressure at the two sides of the sealing pad are equal. But the upper area of the sealing pad is larger than the lower area, the sealing pad is tightly contacted with the fixing seat, the water passage is closed, so that the hand shower head is situated in the water-stop state. When the valve shaft is in the lower position, the sliding block is situated in the low position as figured, the O-ring of the sliding block is separated from the water diversion body, the small waterway passes through the decompression hole, the upper portion of the sealing pad is situated in the decompression state, the pressure approaches to zero, the sealing pad is open under the water pressure at the lower portion, it is situated in water-flowing state, the route is as figured in blue.

The Second Embodiment

Figure 10:
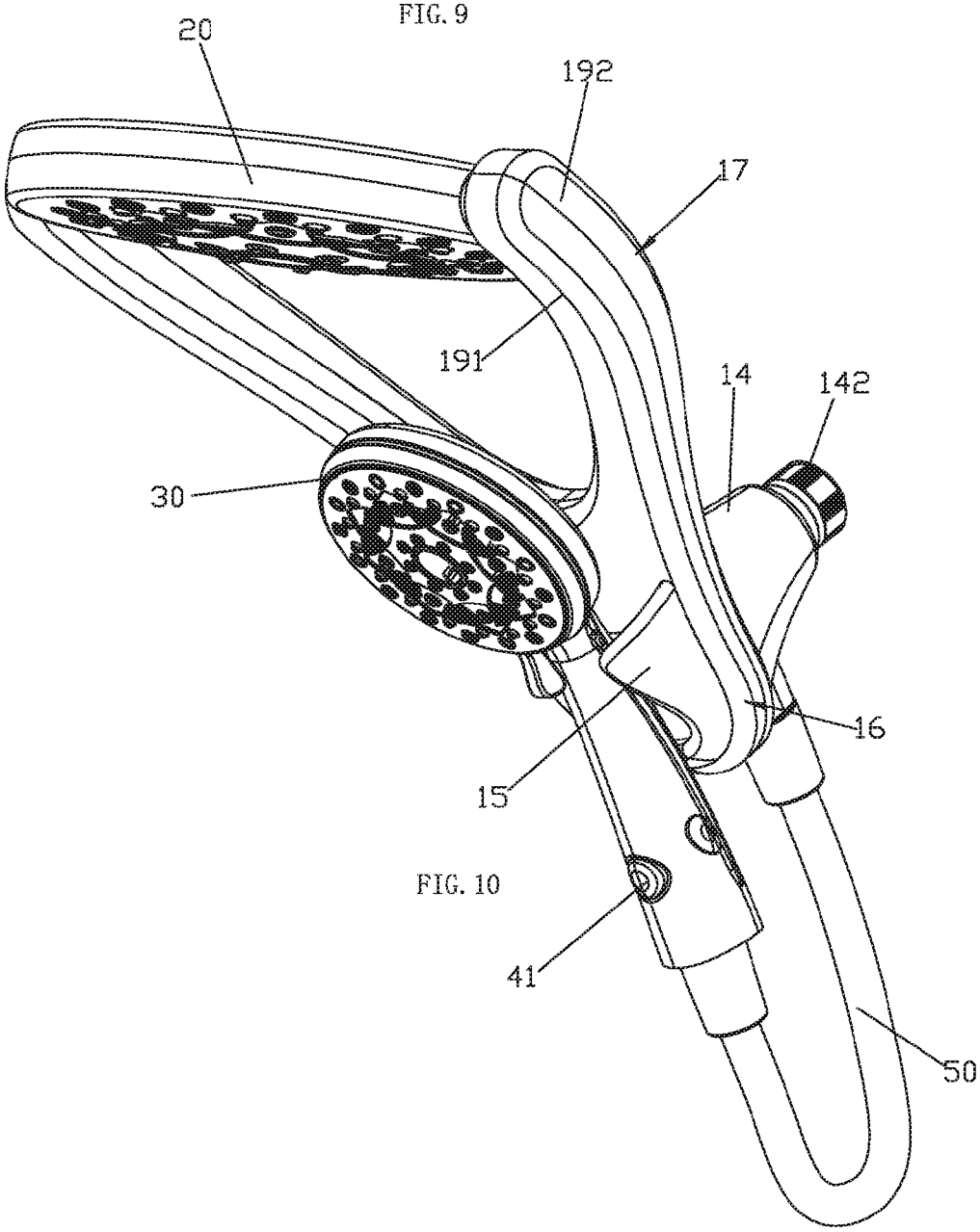
FIG. 10 illustrates a schematic diagram of the combination shower head of the second embodiment.
Figure 11:
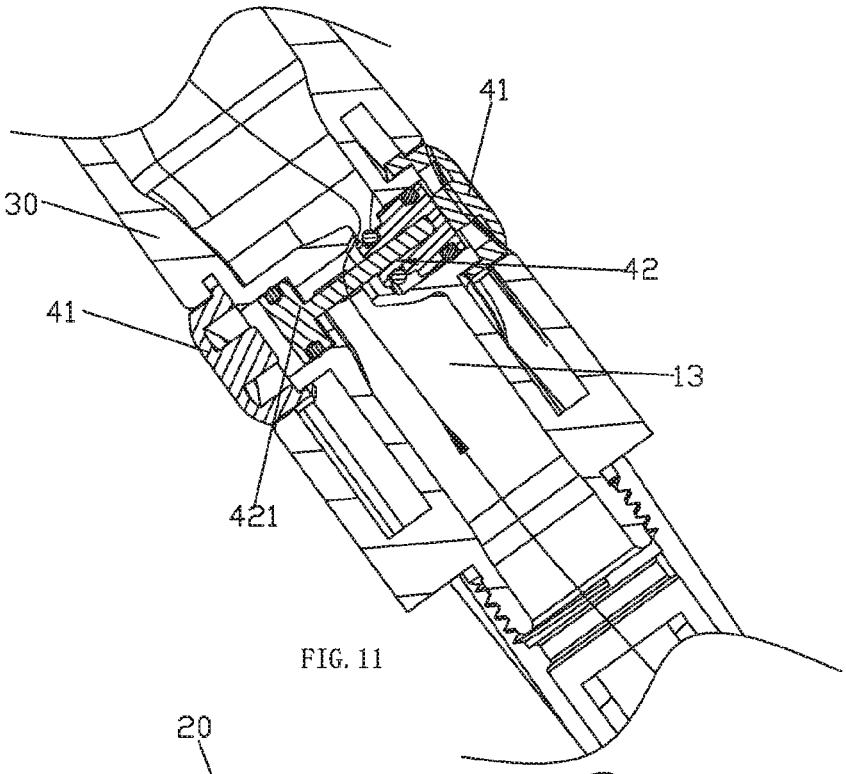
FIG. 11 illustrates a schematic diagram of the control unit of the second embodiment.

This embodiment differs from the first embodiment in that: referring to FIG. 10 and FIG. 11, the control unit 42 comprises a water passage forming a portion of the second diversion waterway and disposed in the hand portion and a swing spool 421 disposed to the hand portion in swinging way. The hand portion is disposed with a fitting hole running through the water passage and connected to the water passage, the swing spool 421 is connected to the fitting hole in sliding way and it is slidable with respect to the fitting hole, two ends of the sliding spool 421 are disposed with sealing element to close both ends; the operation component 41 comprises two buttons, two buttons are respectively coupled to two ends of the swing spool 421 so as to drive the swing spool to slide, each button is pressed to make the swing spool slide far away from the pressing direction. One sealing element of the swing spool 421 is coupled to the water passage, the sealing element slides relatively to control the on-off of the water passage.

The Third Embodiment

Figure 12:
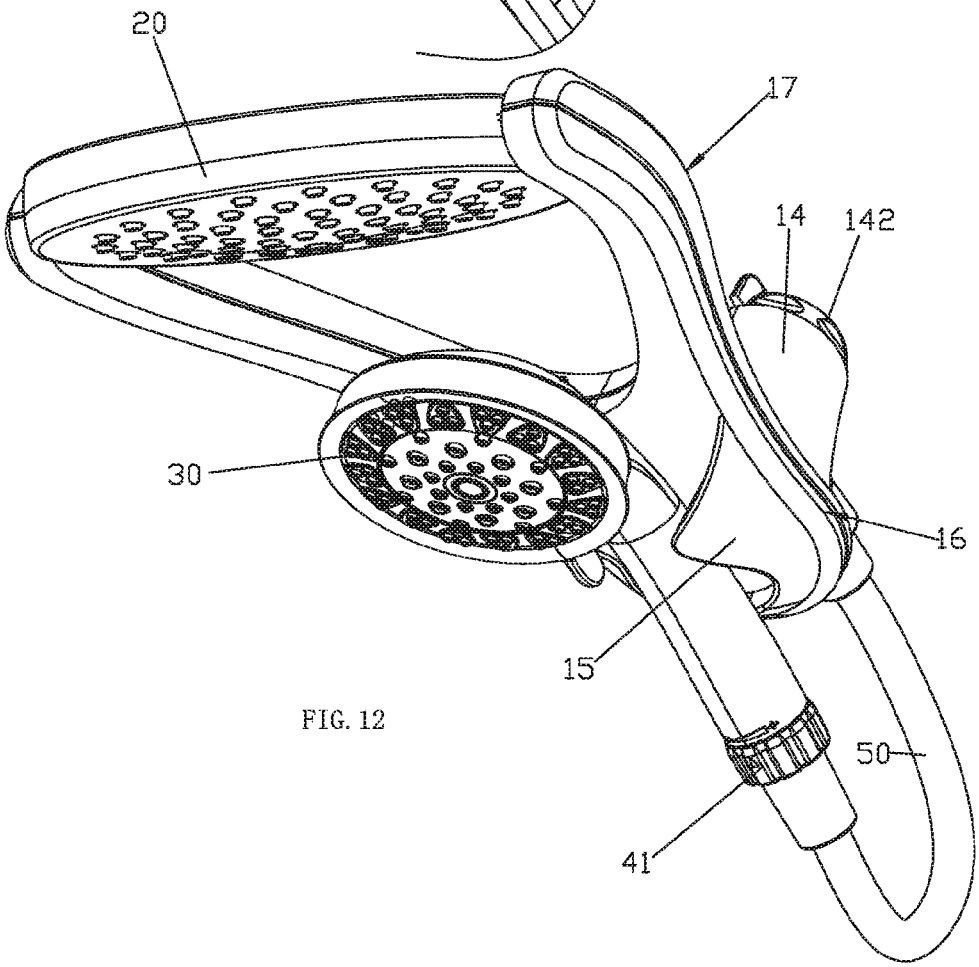
FIG. 12 illustrates a schematic diagram of the combination shower head of the third embodiment.
Figure 13:
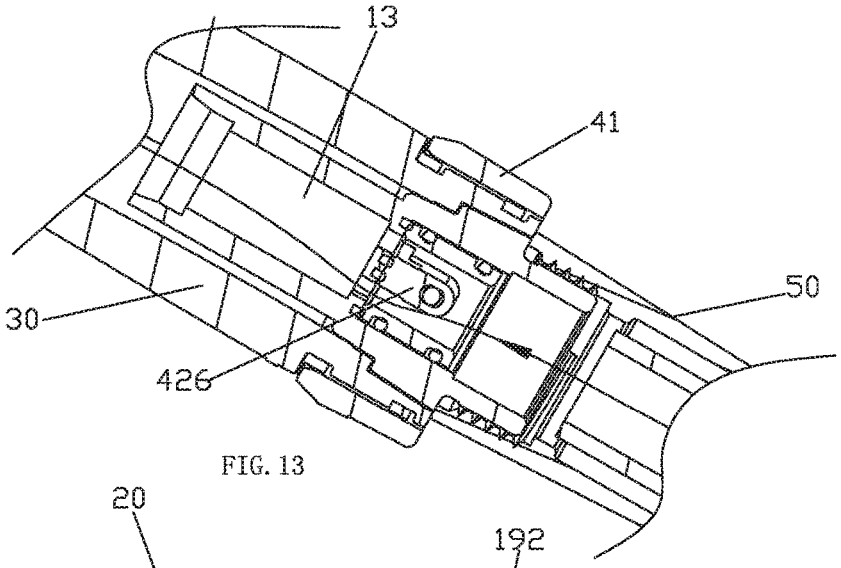
FIG. 13 illustrates a schematic diagram of the control unit of the third embodiment.

This embodiment differs from the first embodiment in that: referring to FIG. 12 and FIG. 13, the control unit 42 comprises a water passage forming a portion of the second diversion waterway and disposed in the hand portion and a rotating spool 426 rotatably disposed in the hand portion. The water passage is disposed in the rotating spool 426, the operation component is a rotating sleeve, which can drive the rotating spool 426 to rotate, the rotating spool 426 rotates to control the water passage and the second diversion waterway to stagger so as to control the on-off of the second diversion waterway.

The Fourth Embodiment

Figure 14:
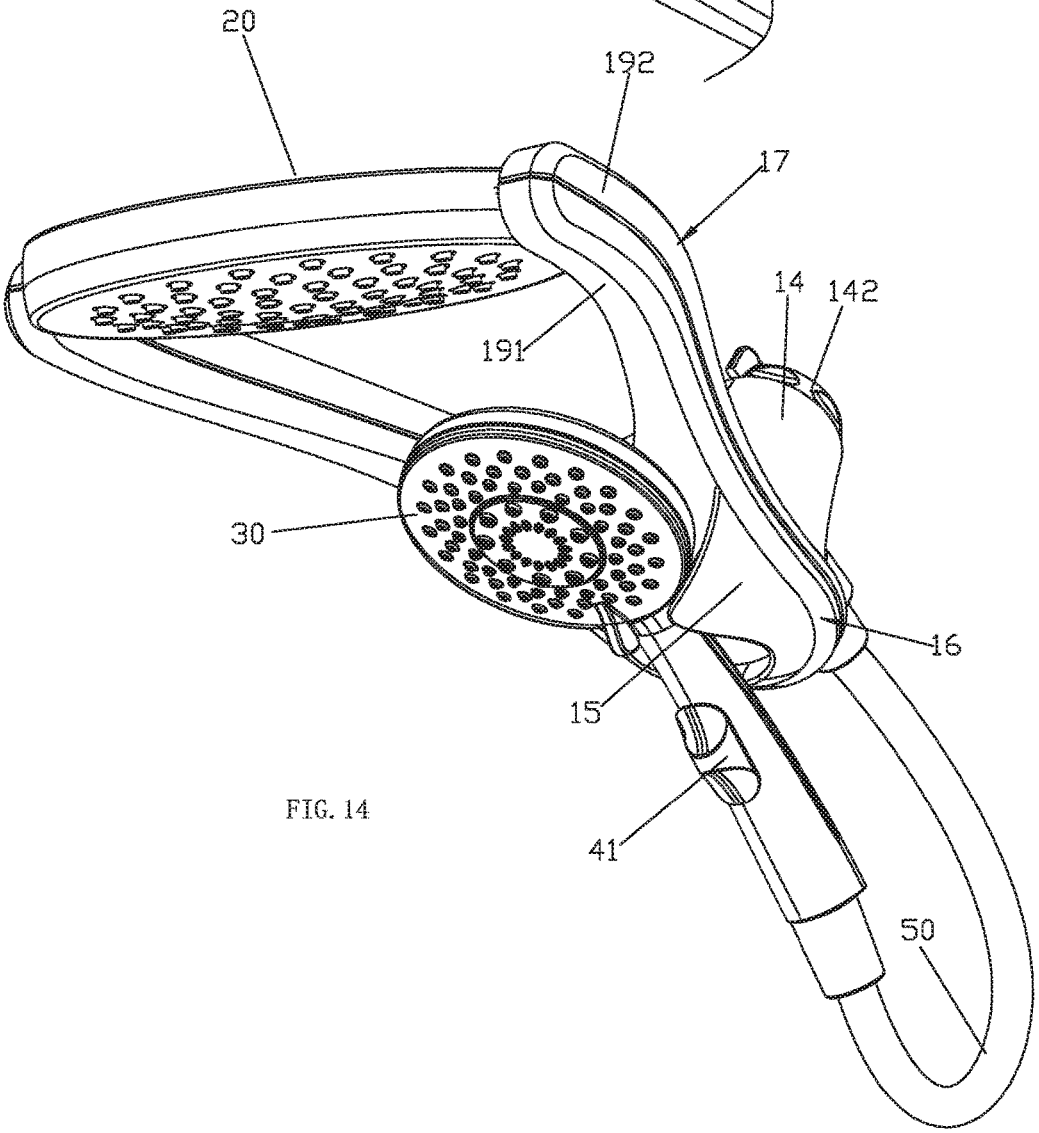
FIG. 14 illustrates a schematic diagram of the combination shower head of the fourth embodiment.
Figure 15:
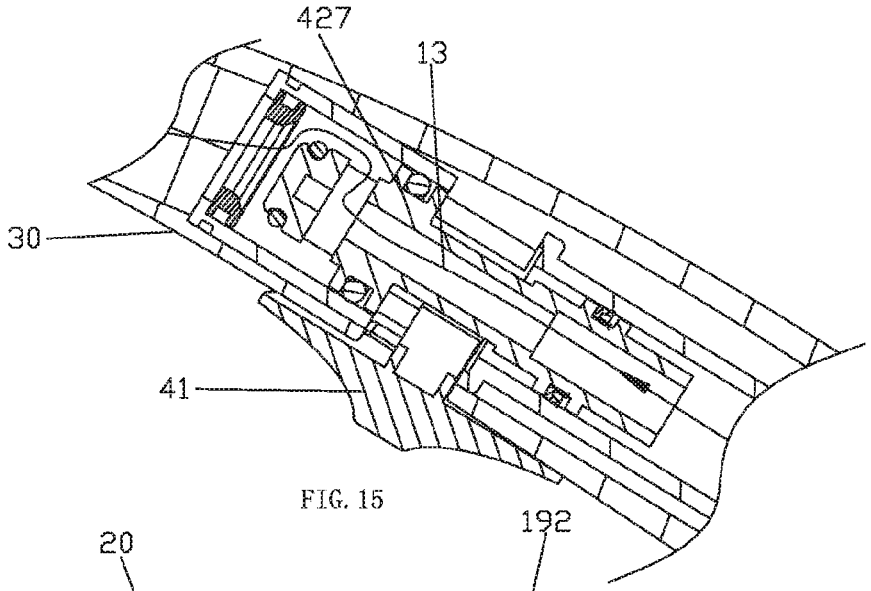
FIG. 15 illustrates a schematic diagram of the control unit of the fourth embodiment.

This embodiment differs form the first embodiment in that: referring the FIG. 14 and FIG. 15, the control unit 42 comprises a water passage forming a portion of the second diversion waterway and disposed in the hand portion and a sliding seat 427 slidable along the length direction of the hand portion, the operation component 41 is a sliding button, the sliding button is connected to the hand portion in sliding way along the length direction of the hand portion, the sliding button is fixedly connected to the sliding seat, the sliding button slides to drive the sliding seat to slide so as to control the on-off of the second diversion waterway.

The Fifth Embodiment

Figure 16:
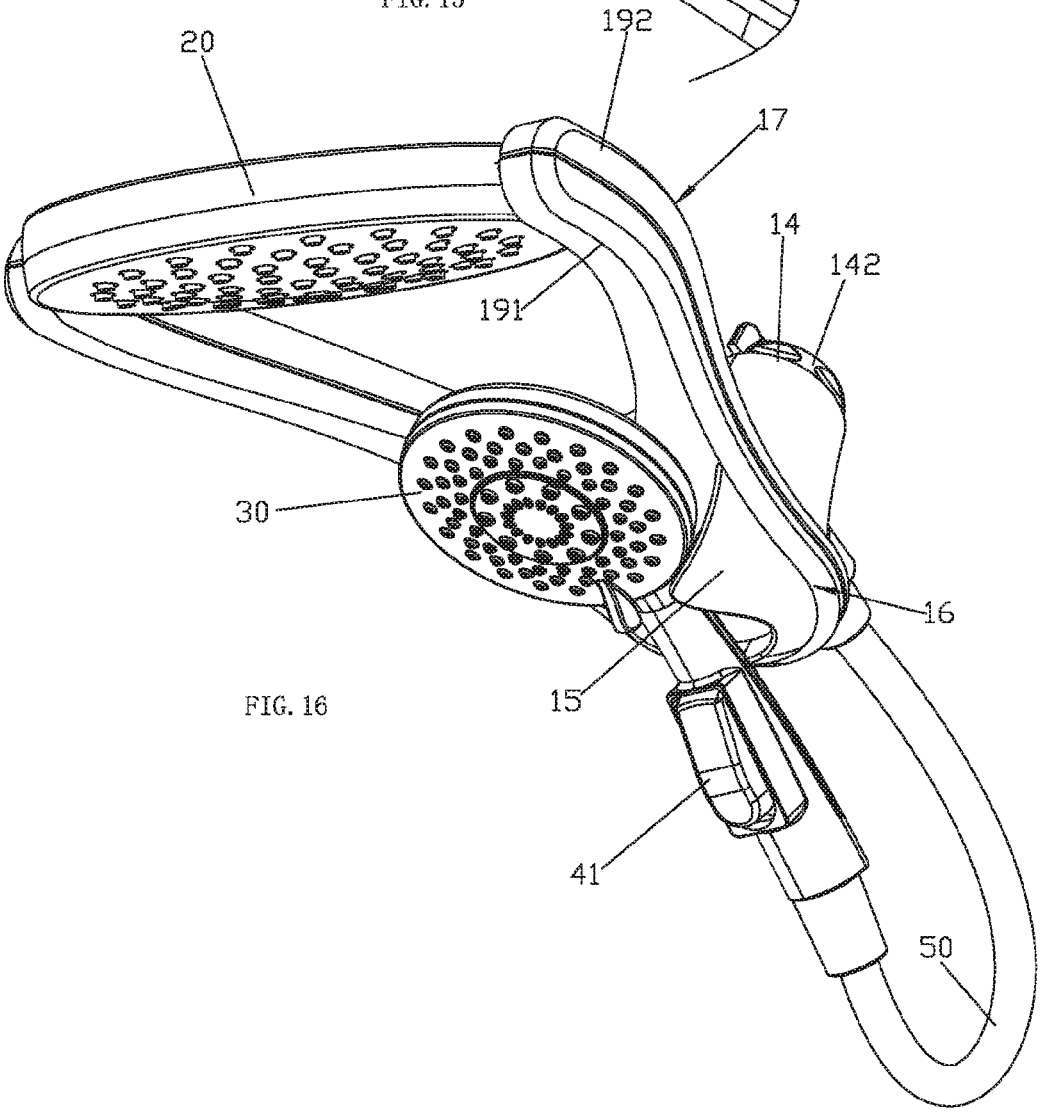
FIG. 16 illustrates a schematic diagram of the combination shower head of the fifth embodiment.
Figure 17:
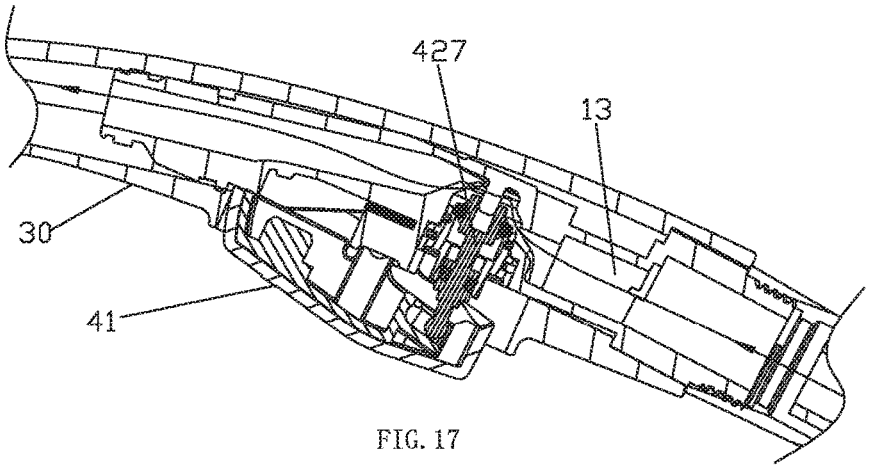
FIG. 17 illustrates a schematic diagram of the control unit of the fifth embodiment.

This embodiment differs from the first embodiment in that: referring to FIG. 16 and FIG. 17, the control unit 42 comprises a water passage forming a portion of the second diversion waterway and disposed in the hand portion and a sliding seat 427 slidable with respect to the hand portion, the operation component is a swing button, the swing button is connected to the hand portion in swinging way, the swing button is connected to the sliding seat in driving way, the swing button swings to drive the sliding seat to slide so as to control the on-off of the second diversion waterway.

The Sixth Embodiment

Figure 18:
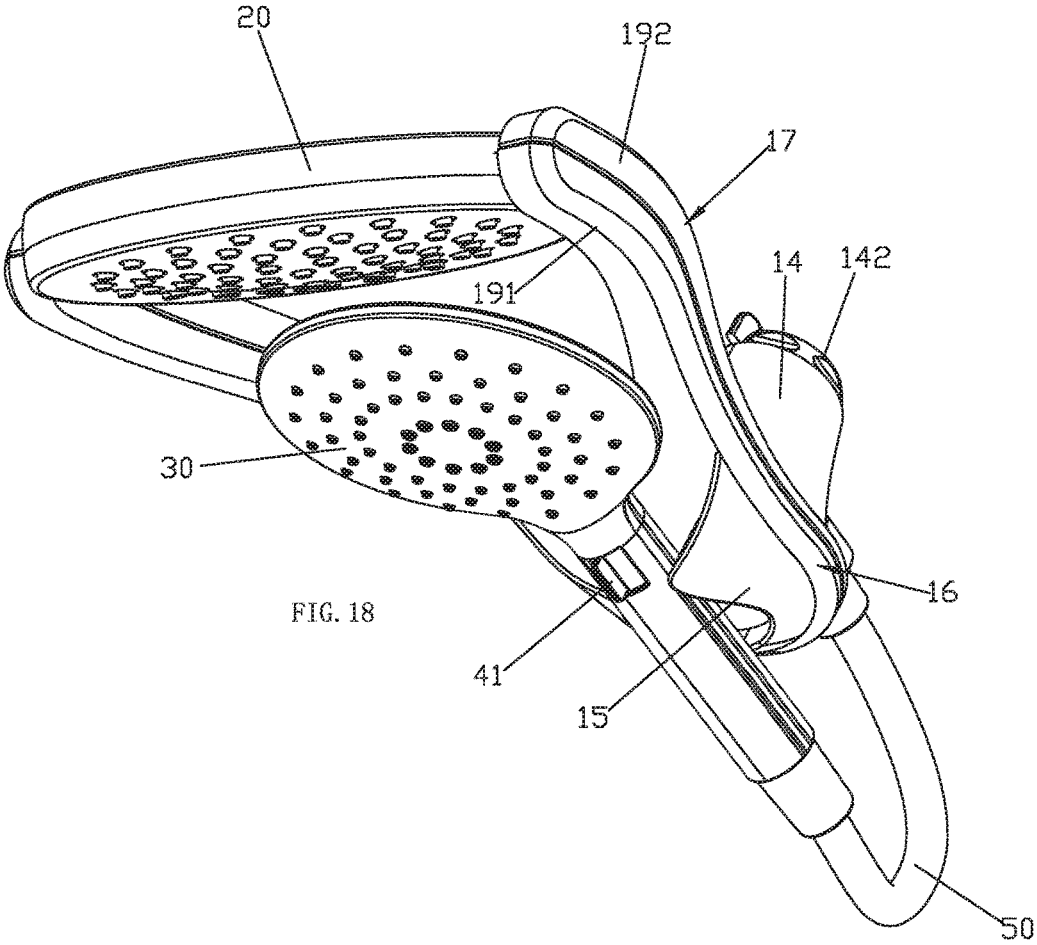
FIG. 18 illustrates a schematic diagram of the combination shower head of the sixth embodiment.
Figure 19:
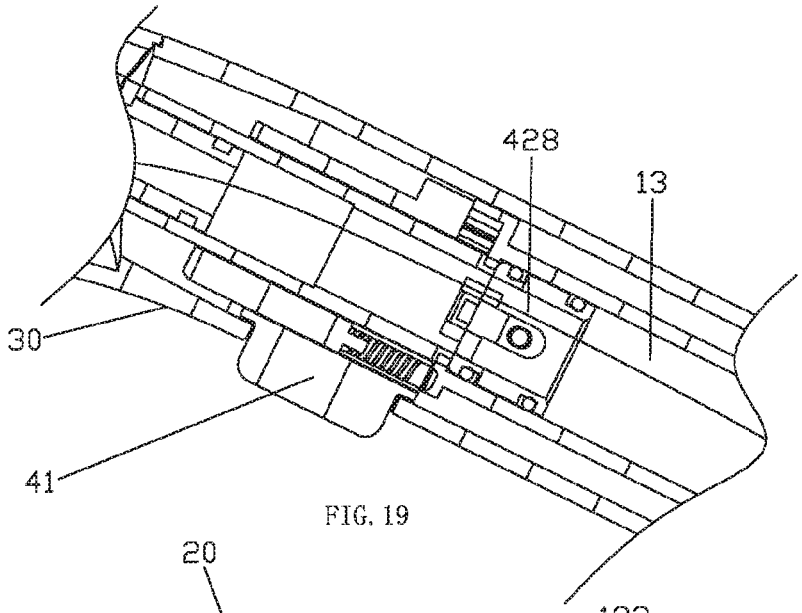
FIG. 19 illustrates a schematic diagram of the control unit of the sixth embodiment.

This embodiment differs from the first embodiment in that: referring to FIG. 18 and FIG. 19, the control unit 42 comprises a water passage forming a portion of the second diversion waterway and disposed in the hand portion and a swing spool 428 disposed to the hand portion in swinging way. The water passage is disposed in the swing spool 428, the operation component is a dial button, which drives the swing spool 428 to swing, the dial button swings to control the water passage and the second diversion waterway to stagger so as to control the on-off of the second diversion waterway.

The Seventh Embodiment

Figure 20:
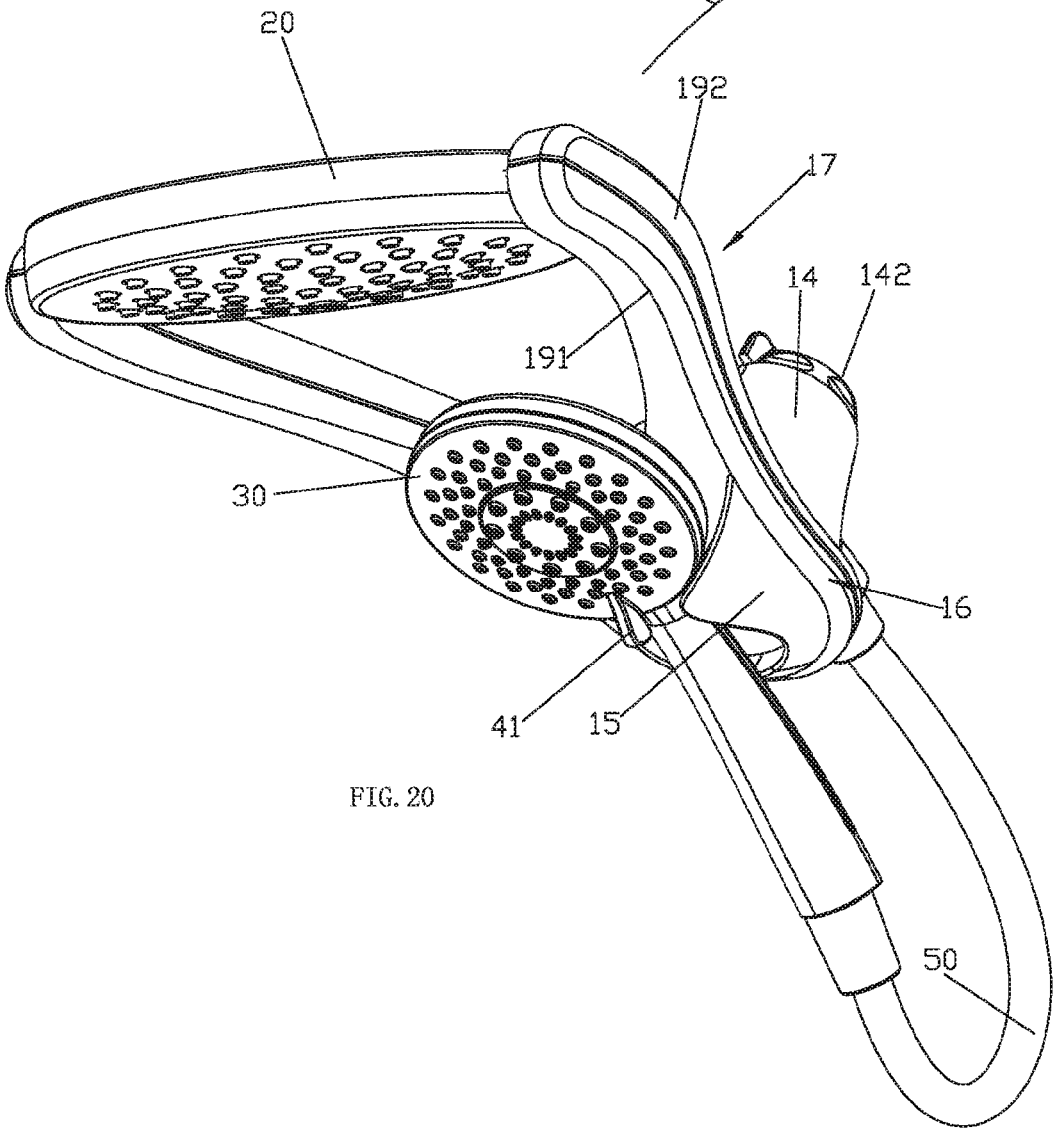
FIG. 20 illustrates a schematic diagram of the combination shower head of the seventh embodiment.

This embodiment differs from the first embodiment in that: referring to FIG. 20, the operation component is disposed at the outlet cover plate of the hand shower head, the on-off of the second diversion waterway is controlled by rotating the cover plate.

The Eighth Embodiment

Figure 21:
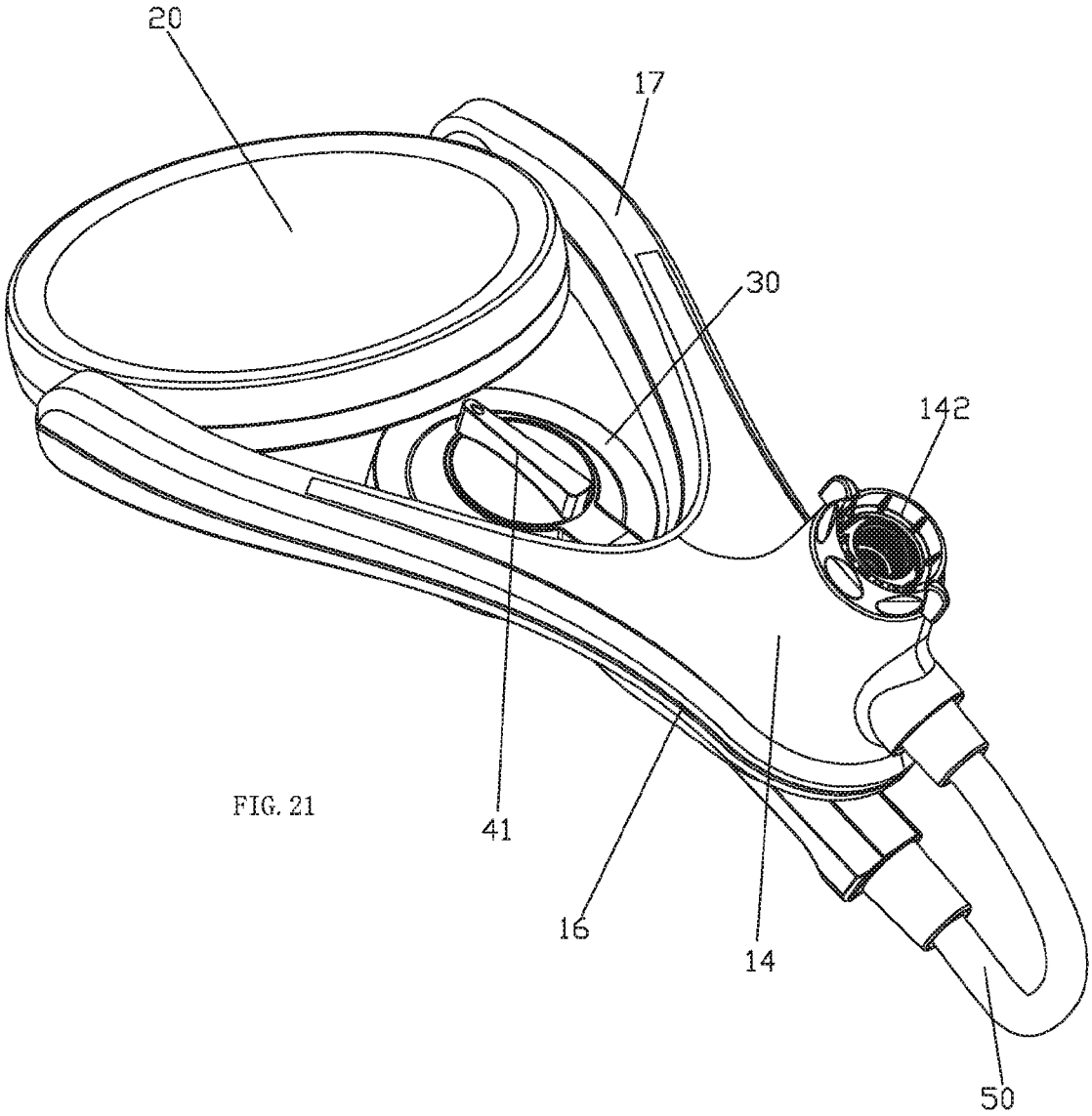
FIG. 21 illustrates a schematic diagram of the combination shower head of the eighth embodiment.

This embodiment differs from the first embodiment in that: referring to FIG. 21, the operation component is disposed at the rear side of the showerhead portion of the hand shower head, the on-off the second diversion waterway is controlled by rotating the operation component.

Although the present invention has been described with reference to the preferred embodiments thereof for carrying out the patent for invention, it is apparent to those skilled in the art that a variety of modifications and changes may be made without departing from the scope of the patent for invention which is intended to be defined by the appended claims.

The invention claimed is:

1. A shower head device, comprising:

a first shower head;

a second shower head;

a switch mechanism;

a fixing seat including an inlet waterway;

a first diversion waterway; and a second diversion waterway;

wherein the first shower head is coupled to the fixing seat and is capable of connecting to the first diversion waterway, the second shower head is a hand shower head connected to the second diversion waterway by a flexible pipe, the switch mechanism comprises a switch component, an operation component, and a control unit, the switch component is in the fixing seat and is coupled to the inlet waterway, a movement of the switching component causing a water way to be switched between the first diversion waterway and the second diversion waterway, the operation component is coupled to the second shower head and controls the movement of the switch component, the control unit is coupled to the second shower head and comprises a valve shaft, a sliding block, a water diversion body, and a decompression hole, the valve shaft and the sliding block are configured to move synchronously and are placeable in either of a high position or a low position, two O-rings are on the sliding block, the water diversion body includes a water passage and a water channel, opening and closing of the water passage is controlled by a sealing pad, when the sliding block is placed in the high position by synchronous movement with the valve shaft, the O-rings seal the water diversion body and prevent water flowing through the water channel to the water diversion body from flowing out through the decompression hole, the sealing pad abuts against the control unit, the water passage is closed and the hand shower head is in a water-stop state, and when the sliding block is placed in the low position by synchronous movement with the valve shaft, the O-rings do not seal the water diversion body, water enters the water diversion body and flows out through the decompression hole, the sealing pad separates from the control unit, the water passage is opened and the hand shower head is in a water-flowing state.

2. The shower head device according to claim 1, wherein the first shower head is rotatably connected to the fixing seat.

3. The shower head device according to claim 1, further comprising a damping mechanism disposed between the fixing seat and the first shower head, wherein the damping mechanism comprises:

a position seat;

a rotation block; and a cam;

wherein the position seat includes at least two suspending sheets arranged at least partly about a space, the at least two suspending sheets form a revolution sleeve of the cam, an inner wall of the revolution sleeve including at least a gradient section with a semi-diameter that gradually changes, the cam is disposed in the revolution sleeve and coupled to the gradient section, the rotation block sleeves an outer side of the revolution sleeve, and when the cam rotates and couples to the gradient section, friction between the at least two suspending sheets and the rotation block changes to adjust damping by the damping mechanism.

4. The shower head device according to claim 1, wherein a rear side of the fixing seat includes a protruding assembly portion, the switch component is in the assembly portion, an outlet of the second diversion waterway corresponds to a peripheral wall of the assembly portion, and a front side of the fixing seat includes a connecting structure for positioning of the second shower head.

5. The shower head device according to claim 4, wherein the fixing seat includes a common portion and two fork portions in a forked arrangement, fixedly connected to the common portion, the first shower head is rotatably connected between the two fork portions, a pipe section is arranged along a rotating axis of the first shower head, and a part of the first diversion waterway is connected to the first shower head along the pipe section.

6. The shower head device according to claim 5, wherein the assembly portion is disposed at a rear side of the common portion.

7. The shower head device according to claim 5, wherein at least one pipe section extends along the rotating axis of the first shower head, and a part of the first diversion waterway is connected to the first shower head along the at least one pipe section.

8. The shower head device according to claim 7, wherein the operation component is connected to the control unit in a driving way to control the on-off of the second diversion waterway, the fixing seat comprises a water diversion portion, the water diversion portion including a water passage and a receiving passage connected to the water passage, two ports of the water passage of the water diversion portion respectively form an inlet of the first diversion waterway and an inlet of the second diversion waterway, the water passage of the water diversion portion and the receiving passage form the inlet waterway, the switch component further comprises a valve spool slidable with respect to the water diversion portion, the valve spool including a fixing rod in the water passage of the water diversion portion, and a sealing portion and a hydro portion respectively fixedly connected to two ends of the fixing rod, the on-off of the second diversion waterway causing a water pressure associated with the sealing portion and the hydro portion to be unequal so as to drive the valve spool to slide with respect to the water diversion portion, when the second diversion waterway is in an on state, the first diversion waterway is closed by the sealing portion and water flows out of the second diversion waterway, and when the second diversion waterway is in an off state, water flows out of the first diversion waterway.

9. The shower head device according to claim 8, wherein the hand shower head includes a hand portion and a shower head portion, and the operation component is disposed in the hand portion, a rear side of the shower head portion or a front side of the shower head portion.

10. The shower head device according to claim 5, wherein the operation component is connected to the control unit in a driving way to control an on-off of the second diversion waterway, the fixing seat comprises a water diversion portion, the water diversion portion including a water passage and a receiving passage connected to the water passage, two ports of the water passage of the water diversion portion respectively form an inlet of the first diversion waterway and an inlet of the second diversion waterway, the water passage of the water diversion portion and the receiving passage form the inlet waterway, the switch component further comprises a valve spool slidable with respect to the water diversion portion, the valve spool including a fixing rod in the water passage of the water diversion portion, and a sealing portion and a hydro portion respectively fixedly connected to two ends of the fixing rod, the on-off of the second diversion waterway causing a water pressure associated with the sealing portion and the hydro portion to be unequal so as to drive the valve spool to slide with respect to the water diversion portion, when the second diversion waterway is in an on state, the first diversion waterway is closed by the sealing portion and water flows out of the second diversion waterway, and when the second diversion waterway is in an off state, water flows out of the first diversion waterway.

11. The shower head device according to claim 10, wherein the hand shower head includes a hand portion and a shower head portion, and the operation component is disposed in the hand portion, a rear side of the shower head portion or a front side of the shower head portion.

12. The shower head device according to claim 1, wherein the fixing seat further includes a water diversion portion having a water passage, the operation component is connected to the control unit in a driving way to control the on-off of the second diversion waterway, the water diversion portion includes a receiving passage connected to the water passage of the water diversion portion, and two ports of the water passage of the water diversion portion respectively form an inlet of the first diversion waterway and an inlet of the second diversion waterway, the water passage of the water diversion portion and the receiving passage form the inlet waterway, the switch component further comprises a valve spool slidable with respect to the water diversion portion, the valve spool including a fixing rod in the water passage of the water diversion portion, and a sealing portion and a hydro portion respectively fixedly connected to two ends of the fixing rod, the on-off of the second diversion waterway causing a water pressure associated with the sealing portion and the hydro portion to be unequal so as to drive the valve spool to slide with respect to the water diversion portion, when the second diversion waterway is in an on state, the first diversion waterway is closed by the sealing portion and water flows out of the second diversion waterway, and when the second diversion waterway is in an off state, water flows out of the first diversion waterway.

13. The shower head device according to claim 12, wherein the hand shower head includes a hand portion and a shower head portion, and the operation component is disposed in the hand portion, a rear side of the shower head portion or a front side of the shower head portion.

14. A shower head device, comprising:

a first shower head;

a second shower head;

a switch mechanism;

a fixing seat including an inlet waterway;

a first diversion waterway; and a second diversion waterway;

wherein the first shower head is coupled to the fixing seat and is capable of connecting to the first diversion waterway, the second shower head is a hand shower head connected to the second diversion waterway by a flexible pipe, the switch mechanism comprises a switch component and an operation component, the switch component is in the fixing seat and is coupled to the inlet waterway, a movement of the switching component causing a water way to be switched between the first diversion waterway and the second diversion waterway, the operation component is coupled to the second shower head and controls the movement of the switch component, and a damping mechanism is disposed between the fixing seat and the first shower head, wherein the damping mechanism comprises:

a position seat;

a rotation block; and a cam;

wherein the position seat includes at least two suspending sheets arranged at least partly about a space, the at least two suspending sheets form a revolution sleeve of the cam, an inner wall of the revolution sleeve including at least a gradient section with a semi-diameter that gradually changes, the cam is disposed in the revolution sleeve and coupled to the gradient section, the rotation block sleeves an outer side of the revolution sleeve, and when the cam rotates and couples to the gradient section, friction between the at least two suspending sheets and the rotation block changes to adjust damping by the damping mechanism.

* * * * *